US007044665B2

(12) United States Patent
Cannell et al.

(10) Patent No.: US 7,044,665 B2
(45) Date of Patent: May 16, 2006

(54) COMPUTERIZED APPARATUS AND METHOD FOR APPLYING GRAPHICS TO SURFACES

(75) Inventors: Robert Cannell, McKinney, TX (US); William Demyanovich, Lyons, CO (US); Ross Mills, Boulder, CO (US)

(73) Assignee: Dreamscape Interiors, Inc., Dallas, CA (US)

( * ) Notice: Subject to any disclaimer, the term of this patent is extended or adjusted under 35 U.S.C. 154(b) by 21 days.

(21) Appl. No.: 10/858,104

(22) Filed: Jun. 1, 2004

(65) Prior Publication Data

US 2004/0247358 A1 Dec. 9, 2004

Related U.S. Application Data

(60) Provisional application No. 60/475,409, filed on Jun. 3, 2003.

(51) Int. Cl.
*B41J 3/28* (2006.01)
*B41J 29/00* (2006.01)

(52) U.S. Cl. ..... 400/323; 400/29; 400/691

(58) Field of Classification Search ..... 400/29
See application file for complete search history.

(56) References Cited

U.S. PATENT DOCUMENTS 4,547,786 A * 10/1985 Logan et al. ..... 347/43
4,937,678 A * 6/1990 Murai et al. ..... 358/528
6,295,737 B1 * 10/2001 Patton et al. ..... 33/18.1
6,467,978 B1 * 10/2002 Tideman, Jr. ..... 400/76
6,736,502 B1 * 5/2004 Deguchi ..... 347/108
6,832,864 B1 * 12/2004 Patton et al. ..... 400/323

FOREIGN PATENT DOCUMENTS

FR 2601265 A1 * 1/1988

* cited by examiner

*Primary Examiner*—Daniel J. Colilla
(74) *Attorney, Agent, or Firm*—Haynes and Boone, LLP

(57) ABSTRACT

The invention is directed to an apparatus for applying at least one graphic to at least one surface, comprising a portable scaffolding system that may be telescoped to accommodate a length and a width of the surface; a host device for receiving at least one head attachment; and a computing device for incrementally moving the host device along the width and the length of the surface and for controlling a distance between the host device and the surface. The invention is also directed to a computer-implemented method for applying at least one graphic to at least one surface, comprising receiving at least one selected graphic; receiving data for mapping the surface; communicating instructions to a horizontal drive means for moving a print head across a width of the surface; communicating instructions to a vertical drive means for moving the print head along a length of the surface; communicating instructions to a host drive means for moving the print head toward and away from the surface; and communicating instructions to the print head for applying at least one colorant to the surface.

14 Claims, 6 Drawing Sheets

COMPUTERIZED APPARATUS AND METHOD FOR APPLYING GRAPHICS TO SURFACES

REFERENCE TO RELATED APPLICATIONS

This application claims the benefit of provisional application Ser. No. 60/475,409, filed Jun. 3, 2003.

BACKGROUND OF THE INVENTION

1. Field of the Invention

The invention is directed generally to apparatus and methods for painting or printing graphics onto walls, ceilings, floors or other surfaces. More specifically, the invention relates to computerized apparatus and methods for applying graphics to surfaces.

2. Description of Related Art

A popular means for varying the appearance of a dwelling, storefront or other building is the application of murals or other graphic displays to a wall, ceiling or floor. The owner can customize a design or picture that adds variety to a living space or provokes conversation among guests and customers. The design is then either painted directly onto the desired surface by an artist or painted onto a material that is applied to the surface. Unfortunately, artists that can reliably paint designs onto a wall or other surface are expensive and the process can take weeks or months to complete.

Previous inventions have attempted to simplify the painting of walls, floors and ceilings. U.S. Pat. No. 5,935,657, to Melendez, discloses an apparatus for painting walls that uses adjustable sets of spray nozzles supplied by a pressurized paint source. The apparatus is mounted on wheels and can be manually pushed across the surface of a wall. The use of the nozzles ensures even painting of the surface. The invention is designed for painting a single color onto a wall and does not allow for customized designs to be painted. Only a single color and horizontal/vertical orientation of each set of nozzles may be altered. Additionally, the apparatus uses multiple stationary paint nozzles, spaced in such a way that an entire section of the painting surface may be covered without gaps in a single pass. Movement of the apparatus is not automated, and it must be manually pushed across the width of the surface being painted.

U.S. Pat. Nos. 6,398,869, 6,319,555 and 5,944,893, to Anderson, attempt to automate movement of the painting device and to provide more customized coloration. The patents claim aspects of a specific print head device, in which paint is applied to an elongated filament and then blown from the filament onto a printing medium, such as vinyl, paper or plastic film. The patents disclose the possibility of using a rigid frame on which the printing device can be mounted. The patents also disclose the computerized control of the direction and coloration of printing performed by the particular print head.

The Anderson inventions are not usable for painting walls, floors or ceilings. The rigid frame disclosed in the patents' dicta seems to be a simple mount for the print head and does not control or possibly even allow movement of the print head about the frame. The rigidity of the frame mount prevents adaptability to surfaces of varying widths and lengths. No features are described that would maintain or vary the distance of the print head from a wall to avoid obstacles in the path of the print head. The Anderson invention is also unable to print around corners to a second surface at an angle with the first.

Hence, there is a great need in the art for an apparatus and method for applying graphics to surfaces such as walls, floors or ceilings. The apparatus must be portable and readily scalable to apply graphics to surfaces of varying sizes. It must be capable of painting or printing customized graphics communicated to it by a remote or connected computing device. The movement of the printing device across the surface being painted or printed must be automated. It should also be able to account for the topography of the surface and any obstacles, such as door and window frames, electrical outlets and switches, and the like. It should also be able to print seamlessly around corners.

SUMMARY OF THE INVENTION

The current invention comprises an apparatus and method for applying graphics to surfaces such as walls, floors or ceilings. The surfaces may be planar or curvilinear where, for example, some bowing, warping or other curvature or inconstancy lies in the shape of the surface. The apparatus is portable and may be readily scaled to print or paint like content on surfaces of varying widths and heights. It paints or prints customized graphics communicated to it by a computing device, which may be remote or connected with the apparatus. The movement of the painting or printing devices used in the invention is automated. It is able to account for topography and obstacles along the surface by mapping the surface prior to applying graphics. It is also able to print seamlessly around corners.

The current invention comprises a portable scaffolding system that may be telescoped to accommodate a length and a width of each surface to be painted or printed. It also comprises a host device for receiving at least one head attachment and a computing device for incrementally moving the host device along the width and the length of each surface and for controlling a distance between the host device and the surface. The portable scaffolding system comprises at least two telescoping vertical members connected via at least one telescoping horizontal brace. The horizontal brace(s) extend between and are perpendicular to the vertical members. The scaffolding system also comprises at least one travel bar connected between and perpendicular to the vertical members. The computing device moves the host device incrementally along the width of the surface by incrementally moving the host device along the travel bar(s).

The invention may also comprise a drive assembly having a vertical drive motor and a horizontal drive motor. The vertical drive motor is connected with the host device via a vertical drive belt. The horizontal drive motor connected with at least one travel bar via at least one horizontal drive rod. The horizontal drive motor and vertical drive motor communicate with the computing device by direct electrical connection or remote means, such as radio or infrared communication. The computing device incrementally moves the host device along the width of the surface by instructing the horizontal drive motor to move the drive assembly along the travel bar. The computing device incrementally moves the host device along the length of the surface by instructing the vertical drive motor to retract or extend the vertical drive belt. The host device may have a host drive motor for moving the host device toward and away from the surface. The host drive motor communicates electronically with the computing device and receives instructions for moving the host device toward and away from the surface.

The head attachment used in accordance with the invention comprises at least one device selected from the group consisting of a print head, a paint head, and a wall mapping device. The attachment may comprise both a head and a mapping device. The wall mapping device may be a device selected from the group consisting of an optical sensor, a laser sensor, and a camera and may contain an illumination device.

Finally, the invention is also directed to a method of using the current invention to apply graphics to a surface. The invention is also directed to a computer-implemented method for applying at least one graphic to at least one surface, comprising receiving at least one selected graphic; receiving data for mapping the surface; communicating instructions to a horizontal drive means for moving a print head across a width of the surface; communicating instructions to a vertical drive means for moving the print head along a length of the surface; communicating instructions to a host drive means for moving the print head toward and away from the surface; and communicating instructions to the print head for applying at least one colorant to the surface.

Where another surface is to be painted or printed, the invented method also comprises communicating instructions to the print head to for applying fiducials aligned with the graphic to a next surface. Data for mapping the next surface is then received. Instructions are then communicated to a horizontal drive means for moving a print head across a width of the next surface; to a vertical drive means for moving the print head along a length of the next surface; to a host drive means for moving the print head toward and away from the next surface; and to the print head for applying at least one colorant, such as a pigment or a dye to the next surface, such that a graphic applied to the next surface is aligned with the fiducials. Instructions may also be communicated to the print head for moving horizontally beyond the maximum range of motion for the horizontal drive means.

DETAILED DESCRIPTION OF THE INVENTION

Figure 1:
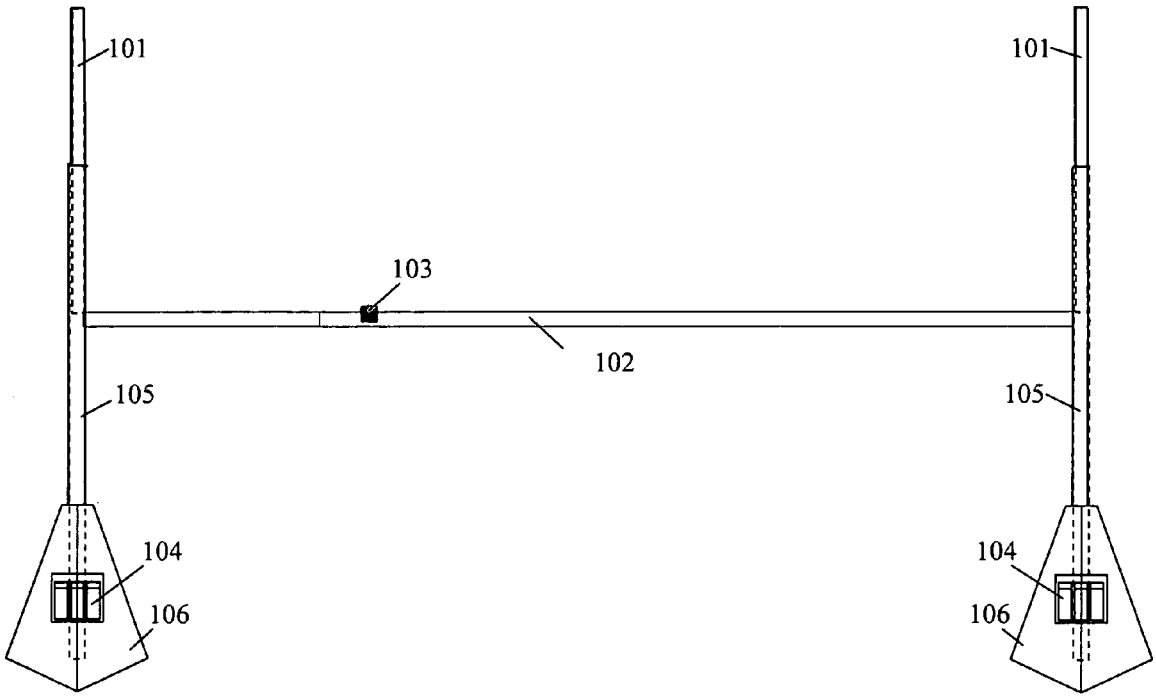
FIG. 1 is an illustration of a first embodiment of the current invention.

Referring now to the figures, wherein like elements are indicated by like numerals, the invention is directed to an apparatus and method for applying graphics to surfaces, such as a wall, ceiling or floor. As stated previously, the surfaces may be planar or curvilinear where, for example, some bowing, warping or other curvature or inconstancy lies in the shape of the surface. FIG. 1 illustrates a first embodiment of the present invention. FIG. 1 shows a portable scaffolding system having two vertical members 101. Each vertical member 101 has two elongated portions that may be extended telescopically to accommodate the full height of a wall, when vertical members 101 are perpendicular to a floor; or, to accommodate the length of a floor or ceiling, when vertical members 101 are parallel to the floor or ceiling. The scaffolding also contains at least one horizontal travel bar 102 connected with and perpendicular to the vertical members. The travel bar 102 also has two lengths, such that its length may be telescopically varied to accommodate the width of the printing or painting surface.

Vertical members 101 may be formed of any sturdy material that will not bend or warp in response to tension applied between them or the weight of any parts attached to travel bar 102. Examples of such materials may comprise steel, aluminum or other lightweight metal tubing, as well as poly-vinyl chloride or other suitable plastic tubing. Each vertical member 101 may be formed integrally with a base 105, such that one length of vertical member 101 and base 105 are one piece. Alternatively, they may be formed separately and connected modularly. Preferably, they are formed separately and connected modularly, such that base 106 may be removed when painting or printing a surface that does not require vertical members 101 to stand upright.

The arms of travel bar 102 may be formed of any sturdy material that will not bend or warp in response to the weight of any parts attached to it. Examples of such materials may comprise steel, aluminum or other lightweight metal tubing, as well as poly-vinyl chloride or other suitable plastic tubing. The material used to form travel bar 102 may comprise the same material as that used for vertical members 101. Alternatively, it may comprise a different material than that used for vertical members 101. Alternatively, it may comprise the same material with different thickness or other dimensions than that used for vertical members 101.

The invention also includes a host device 103 that is movably attached to travel bar 102. Host device 103 comprises a housing that is adapted to receive one or more head attachments, which may include a print or paint head, or a mapping device, such as an optical sensor. Host device 103 also comprises an electronic step motor that controls the movement of host device 103 across travel bar 102.

Electronic step motors may also be placed in the base of each vertical member 101. The step motors may be used to gradually raise or lower the telescopic arms of vertical members 101. This allows host device 103 to move across the next highest or next lowest line to be mapped, painted or printed on the surface. Paint or ink supplies 104 may also be housed in the base of each vertical member 101, for re-filling a print head that is placed in host device 103.

Figure 2A:
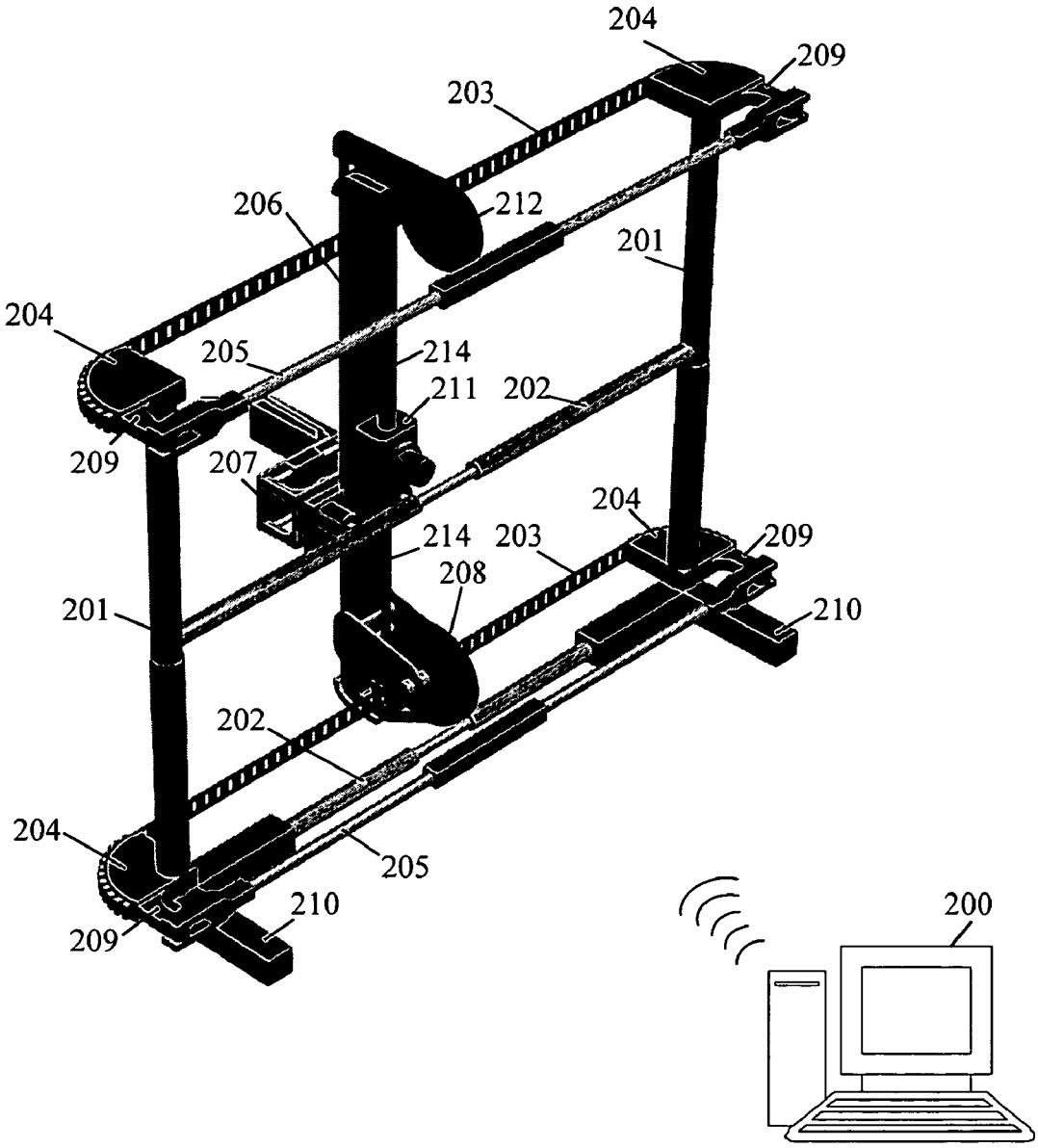
FIG. 2A is an illustration of a rear perspective view of a second embodiment of the current invention.

FIG. 2A illustrates a second and preferred embodiment of the present invention. FIG. 2A shows a portable scaffolding system having two vertical members 201. Each vertical member 201 is telescopic, such that it may be extended telescopically to accommodate the full height of a wall, when vertical members 201 are perpendicular to a floor; or, to accommodate the length of a floor or ceiling, when the vertical members 201 are parallel to the floor or ceiling. Each vertical member 201 has a proximal end and a distal end, both of which are connected with a tensioning cam 204. Each tensioning cam 204 is oriented such that its teeth face the painting or printing surface and a tensioning arm 209 extends away from the painting or printing surface. The distal end of each vertical member 201 may also be connected with a base 210 for supporting the vertical member 201 on a floor. The base 210 may be square, L-shaped, or any suitable shape for preventing tippage of the scaffolding system.

The scaffolding system also contains at least one horizontal brace 202 connected with and perpendicular to vertical members 201. Each horizontal brace 202 is telescopic, such that its length may be varied to accommodate the width of the printing or painting surface. Preferably, two horizontal braces 202 are used, one about the midpoints of vertical members 201 when they are fully collapsed, and one at the distal ends of vertical members 201 or connected with platforms 209. The scaffolding system may also contain at least one tensioning turnbuckle 205 for maintaining an exact width between vertical members 201. Each tensioning turnbuckle 205 may grip the arms of both tensioning cams 204 at the proximal or distal ends of the vertical members 201. Alternatively, the tensioning tumbuckles 205 may hook around the arms 209 of the tensioning cams 209, thereby pulling the vertical members 201 toward one another.

The scaffolding system also contains at least one travel bar 203. Each travel bar 203 may comprise a flexible strip having evenly spaced apertures for receiving teeth of tensioning cams 204. Each travel bar is stretched between tensioning cams 204 at the proximal or distal ends of vertical members 201. The flexibility of travel bars 203 allows them to be adjusted to the telescoped length of the horizontal braces 202, while maintaining constant dimensions along the lengths of travel bars 203.

Vertical members 201 may be formed of any sturdy material that will not bend or warp in response to tension applied between them or the weight of any parts in contact with to travel bars 203. Examples of such materials may comprise steel, aluminum or other lightweight metal tubing, as well as poly-vinyl chloride or other suitable plastic tubing. Horizontal braces 202 may be formed of any sturdy material that will not bend or warp in response to the tension applied between vertical members 201 by parts attached to travel bars 203 or by tensioning turnbuckles 205. Examples of such materials may comprise steel, aluminum or other lightweight metal tubing, as well as poly-vinyl chloride or other suitable plastic tubing. The material used to form horizontal braces 202 may comprise the same material as that used for vertical members 201. Alternatively, it may comprise a different material than that used for vertical members 201. Alternatively, it may comprise the same material with different thickness or other dimensions than that of vertical members 201.

Tensioning cams 204 may be composed of any sturdy material that will not bend, warp or break in response to the tension of travel bars 203 against their teeth or tensioning turnbuckles 205 against their arms 209. Vertical members 201 may be formed such that tensioning cams 204 are integrated with the ends of vertical members 201. Alternatively, tensioning cams 204 may be separately formed and connected modularly with vertical members 201. Preferably, tensioning cams 204 are integrated with the ends of vertical members 201. Bases 210 may also be integrally formed with the distal end of each vertical member 201. Alternatively, bases 210 may be separately formed and connected modularly with vertical members 201. Preferably, bases 210 are separately formed and connected modularly with vertical members 201, such that platforms 210 may be removed when painting or printing a surface that does not require the scaffolding system to stand upright.

Travel bars 203 may be composed of any flexible material that may stretch and yet not sag or tear in response to the weight of parts that travel bars 203 support. Such materials may comprise rubber or a suitable flexible or semi-rigid polymer material.

Figure 3:
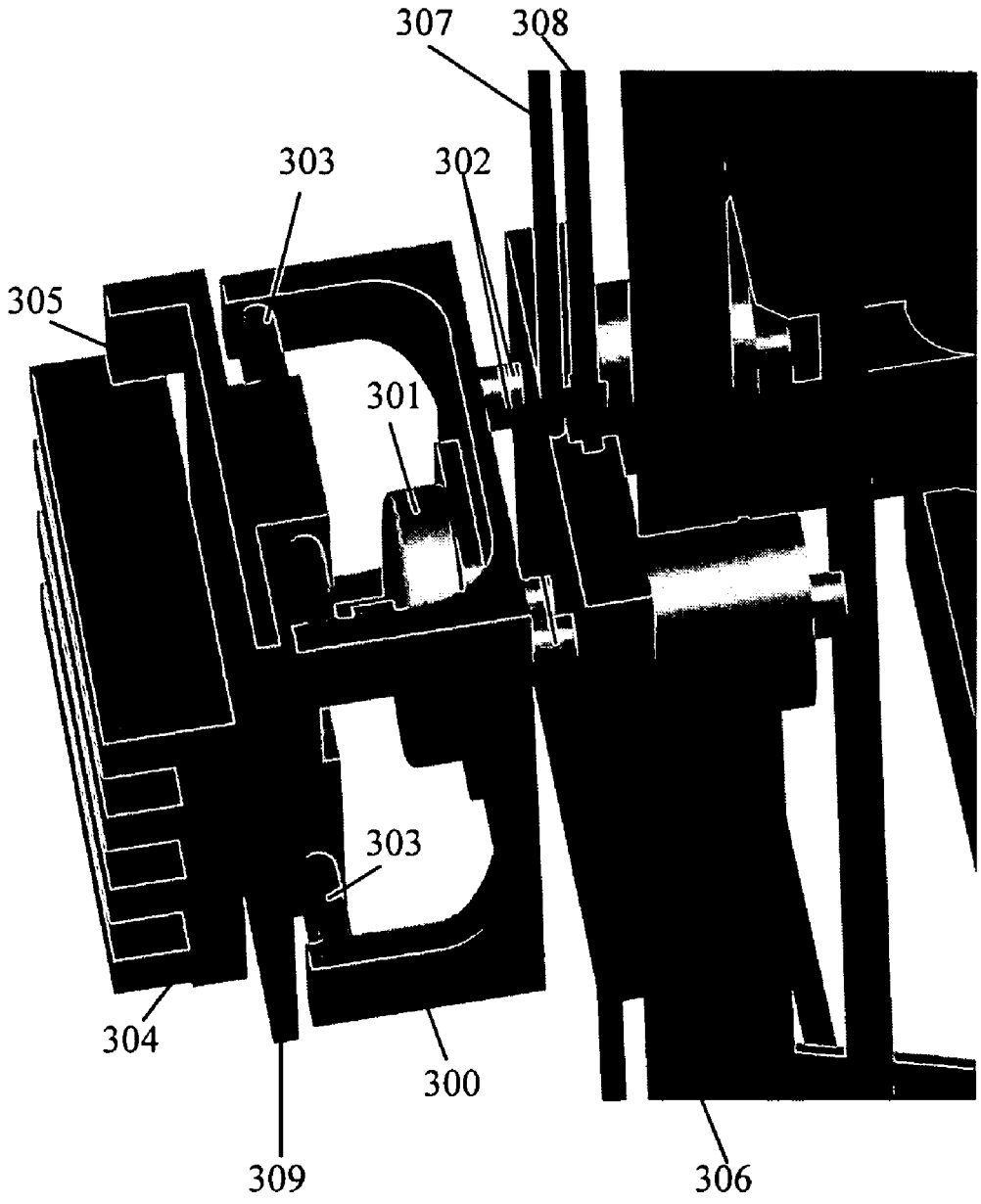
FIG. 3 is an illustration of a side perspective view of a host for receiving and directing a wall printing device, such as a print head or mapping device.

The embodiment of the invention shown in FIG. 2A also comprises a host device 207. Host device 207, described in further detail with reference to FIG. 3, is adapted to receive one or more head attachments, which may include a print or paint head, or a mapping device.

Figure 2B:
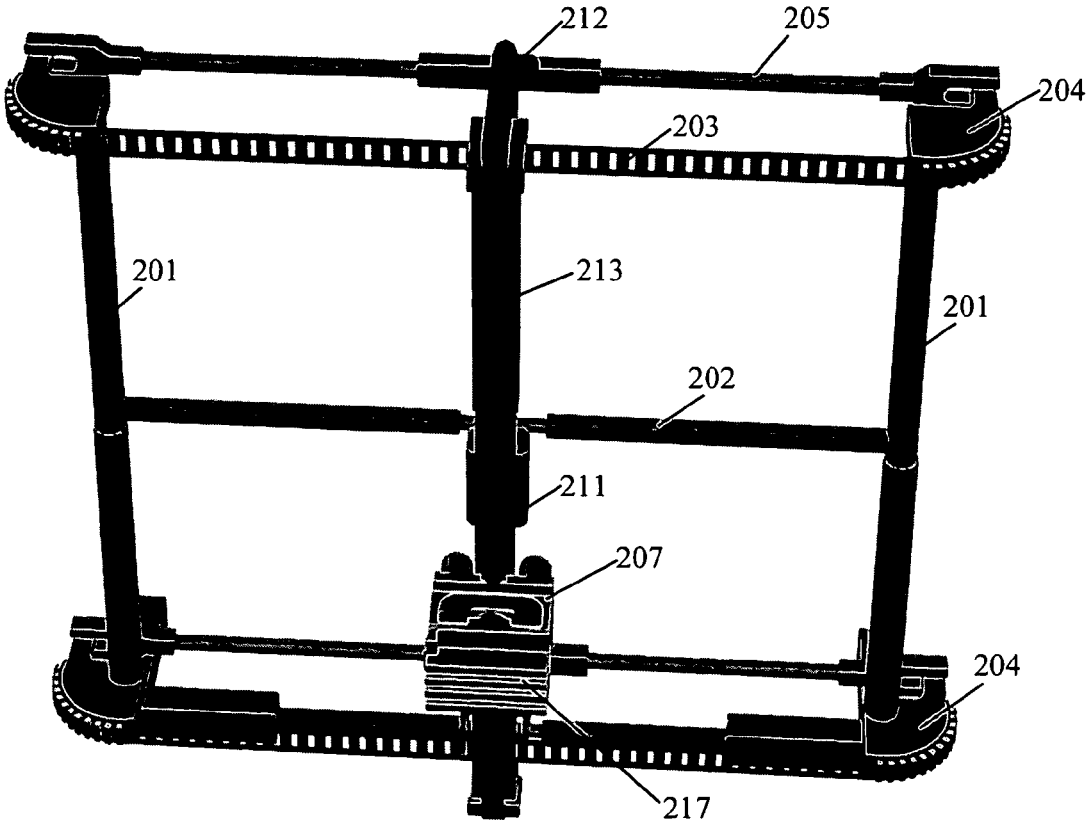
FIG. 2B is an illustration of a front perspective view of a second embodiment of the current invention.

The embodiment of the invention shown in FIG. 2A also comprises a vertical drive assembly 206 having a vertical track reel 208, a vertical drive motor 212, a horizontal drive motor 211, and a vertical drive belt, shown as 213 in FIG. 2B. Vertical drive belt 213 may comprise a rubber or plastic belt or metal chain and is connected with host device 207. Vertical drive motor 212 moves drive belt 213 about its reel, such that host device 207 moves incrementally in either direction along the length or height of the surface to be painted or printed. Vertical drive motor 212 contains motion control circuitry that receives instructions from a computing device 200 via an electronic drive board, a receiver, an antenna or other suitable communication means.

Horizontal drive motor 211 moves vertical drive assembly 206 horizontally across travel bars 203, in incremental steps along the width of the surface to be painted or printed. Horizontal drive motor 211 contains motion control circuitry that receives instructions from computing device 200 via an electronic drive board, an antenna or other suitable communication means. Horizontal drive motor 211 turns horizontal drive rods 214, simultaneously, in the same direction. Horizontal drive rods 214 contact travel bars 203, either frictionally or with teeth that fit in the apertures of travel bars 203. The turning of horizontal drive rods 214 moves vertical drive assembly 206 across travel bars 203 in incremental steps, according to instructions received from the computing device 200.

Computing device 200 may comprise any suitable computing device for loading and editing graphic displays, storing and processing wall topography data and communicating with the horizontal drive motor and other motors requiring instruction, as described herein. Computing device 200 may comprise a desktop or laptop computer or a portable computing device, such as a personal data assistant or pocket PC. Computing device 200 may communicate with the various motors described herein through direct electrical connection or via radio, infrared or other communication means. Preferably, remote communication means is used that does not interfere with other remote devices in a home or other structure, such as electronics equipment, wireless networks or cordless telephones.

FIG. 2B illustrates a front perspective view of the invention. FIG. 2B further illustrates vertical drive assembly 206, by showing a vertical drive belt 213 connected with host device 207. As stated, vertical motor 212 moves host device 207 in a vertical line by retracting and extending vertical drive belt 213 about the reel of vertical motor 212.

Those skilled in the art will recognize that the number of vertical towers used in FIGS. 2A and 2B is not intended to limit the invention's scope. For instance, where painting or printing surfaces are so wide that the travel bars cannot support vertical drive assembly without sagging, additional towers may be used between the towers that frame the width of the painting or printing surface.

FIG. 3 illustrates a side perspective view of the host device, in accordance with the invention. The host device is primarily responsible for maintaining the distance and alignment of a head attachment with respect to a surface to be painted or printed. The host device comprises a housing 300, a motor 301, and guides 302. Motor 301 moves housing 300 toward or away from the painting or printing surface along guides 302. Motor 301 contains motion control circuitry that receives instructions from a computing device via an electronic drive board, receiver, antenna or other suitable communication means. The host device preferably contains between at least two equidistant guides 302. Most preferably, the host device contains three guides 302 placed in a triangular configuration, as shown in FIG. 3. The motion of housing 300 moves head attachment 304 toward and away from the painting or printing surface. Guides 302 must be sufficiently long to enable the print head to avoid thick obstacles, such as door and window frames.

The host device also comprises a vertical motion platform 306 that is connected with housing 300 via guides 302. Vertical motion platform 306 connects with vertical drive belt 307 (also shown at 213 in FIG. 2B). Vertical drive belt may be connected with the side of vertical motion platform 306 that faces the vertical drive motor (shown at 212 in FIGS. 2A and 2B). Alternatively, a second vertical drive belt may be attached in line with vertical drive belt 307 on the underside of vertical motion platform 306, such that it moves about the vertical track reel (shown at 208 in FIG. 2A). Vertical motion platform 306 contains a recessed portion for receiving vertical drive track 308, such that host device moves in a straight vertical line along vertical drive track 308, when the vertical drive motor (shown at 212 in FIG. 2A) retracts or extends vertical drive belt 307.

The host device also comprises a horizontal motion platform 309, which moves across guiderails 303. Guiderails 303 are parallel and connected with the corners of housing 300 as shown. Guiderails 303 enable horizontal motion platform 309 to move horizontally along them to reach areas of the painting or printing surface that are unreachable due to the position of the vertical drive assembly. For instance, when horizontal movement of the vertical drive assembly is prevented by either vertical tower, guiderails 303 allow the print head to continue moving horizontally. This prevents the width of the painting or printing surface from being reduced by the width of the towers or bases of the towers.

Head attachment 304 is removably and pivotally attached with horizontal motion platform at corner swivel 305. As stated, head attachment 304 may comprise a paint head, print head, or mapping device. Mapping devices may comprise an optical sensor, laser sensor, camera or other suitable device for mapping surface topography, and may include illumination devices. Head attachment 304 may be pivoted about swivel 305, in order to paint, print or map around corners or angles, and continue printing, painting or mapping adjoining surfaces. This is shown and described in further detail with reference to FIG. 4.

The print or paint heads used in accordance with the present invention may comprise any industrial paint or print head suitable for printing graphics of the scale necessary to cover surfaces such as walls, ceilings or floors. Preferably, the print or paint head should be capable of holding a sufficient amount of colorant to prevent frequent refilling during painting or printing of a single surface. The print head also contains motion control circuitry that receives instructions from a computing device via an electronic drive board, an antenna or other suitable communication means, such that the print or paint head can move about guiderails on the host device, as described herein. The print head may also contain mapping devices, such that it maps a surface entirely without switching devices, or such that it maps the surface on the fly, a certain number of horizontal and vertical lines ahead of printing or painting. The print head may also be separate from the mapping device but have a sensor for verification of the topography during printing or painting. Preferably, the surface is mapped entirely by a separate mapping device, such that degradation of the mapping device or print head will not necessitate replacement of both devices. Preferably, the print head has a sensor for verifying topography on the fly.

Figure 4:
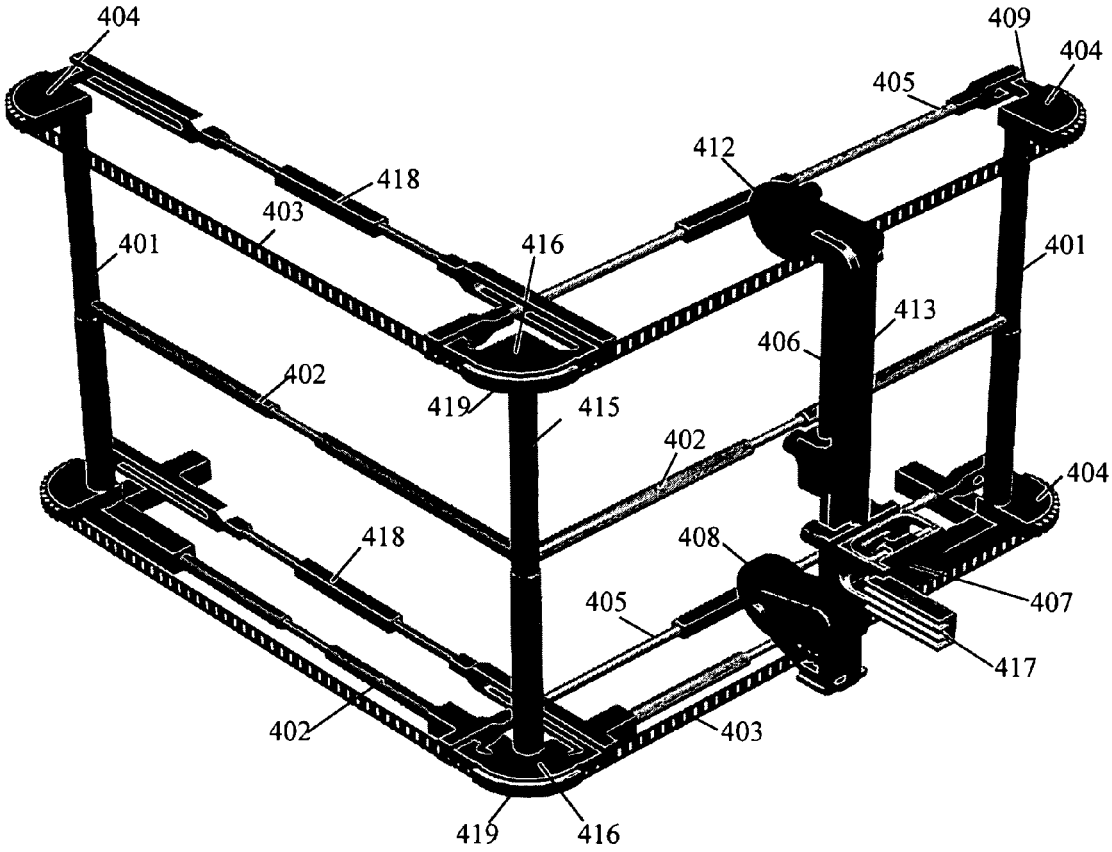
FIG. 4 is an illustration of a two-wall embodiment of the current invention.

FIG. 4 illustrates a two-surface embodiment of the current invention. The two-surface embodiment employs the same features as the single-surface embodiments described previously, with additional elements. This embodiment will be described for walls that form right angles with each other, though those skilled in the art will appreciate that the embodiment may be used for walls, ceilings and floors that form different angles or which have concave rounded corners. Vertical members 401 are separated from each other by two horizontal braces 402 that are connected at a right angle via midpost 415. Vertical members 401 and midpost 415 are all connected or integrated with tensioning cams 404 and 416, respectively, which support horizontal travel bars 403. Tensioning cams 416 differs from tensioning cams 404 in that they have two arms 409 for supporting tensioning tumbuckles 405 and 418. Tensioning turnbuckles 418 also differs from tensioning turnbuckles 405, in that they must be able to extend past tensioning turnbuckles 405 to the opposite arm of tensioning cam 416, while remaining parallel to horizontal braces 402.

FIG. 4 illustrates head attachment 417 connected with and perpendicular to host device 407. This is the second-surface position for head attachment 417. In order to align the image on a first wall or surface with that on the adjoining wall or surface, print head 417 extends into the second-surface position, when it reaches the corner between the surfaces. It prints or paints fiducial marks on the second surface that act as guidemarkers for the continuation of the graphics being painted or printed on the first surface. When the second surface is mapped for painting or printing, the mapping device detects the fiducial marks and communicates them to the computing device that instructs the various motors, as described previously. This allows the computing device to instruct the vertical, horizontal and print head motors to paint or print graphics that are aligned with the image on the first surface.

Once printing or painting of the first surface is completed, vertical drive assembly 406 can either be manually replaced onto those travel bars 403 that face the second surface, or vertical drive assembly may automatically transition around the corners. Preferably, vertical drive assembly 406 automatically transitions around the corners. The horizontal drive rods (shown as 214 in FIG. 2A) of vertical drive assembly 406 disengage with those travel bars 403 facing the first surface, engage corner guides 419, which cover the teeth of midpost cams 416, and then engage those travel bars 403 facing the second surface.

Figure 5:
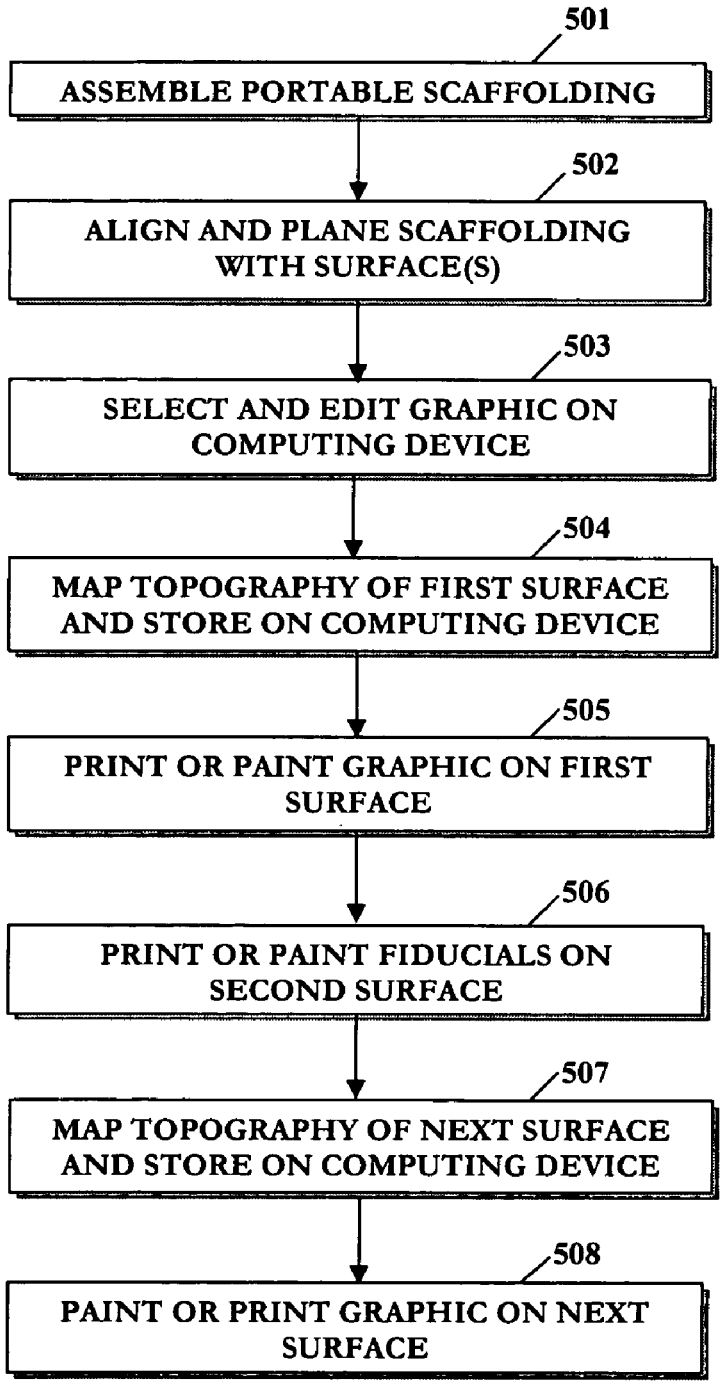
FIG. 5 is a flow diagram illustrating steps for a method of using the current invention.

The present invention is also directed to a computer-implemented method of painting or printing a graphic on surfaces, such as walls, floors or ceilings. As stated previously, the surfaces may be planar or curvilinear where, for example, some bowing, warping or other curvature or inconstancy lies in the shape of the surface. FIG. 5 illustrates steps of the invented method. In accordance with step 501, a portable scaffolding system of any type disclosed herein is assembled such that a head attachment will face the surface to be painted or printed when it is attached to the host device. In accordance with step 502, the scaffolding system is aligned and planed, such that it will paint or print a graphic level with the plane occupied by the surface. Alternatively, the scaffolding system may be aligned with the surface but planed at an angle with the surface, such that the graphic is printed or painted on the surface at a constant angle. If a second wall is to be painted or printed, then the two-surface embodiment of the current invention may be aligned or planed with each surface.

In accordance with step 503, at least one graphic is received into random access memory of a computing device. The graphics may be selected from a database of graphics that is stored on the computing device or on a remote computing device that communicates with the computer via a local area network, a wide area network, or via the Internet. The selected graphics may be edited via the computing device, if necessary. Where two walls are painted or printed, the selected graphics may the same, different or continuations of each other.

In accordance with step 504, the topography of the surface to be painted or printed is mapped. A wall mapping device is attached to the host device of the scaffolding system, as described herein. The host device then steps across the surface to be painted or printed in horizontal or vertical lines and communicates the presence of obstacles and varying thicknesses on the surface. Where the host device is prevented from further movement, the host device moves across guiderails on the host device to access the full width of the surface, as described herein. The wall mapping device communicates data to the computing device for mapping the surface.

In accordance with step 505, a selected graphic is painted or printed onto the first surface. A print or paint head is attached with the host device of the scaffolding system, as described herein. The computing device communicates with the print or paint head and instructs it to emit colorants of varying colors, while communicating with motors that control the horizontal and vertical motion of the host device and the distance of the host device from the surface. It also communicates with the paint or print head to move along the disclosed guiderails when the movement of the host device is obstructed by the vertical members of the scaffolding system or other obstacles. Where two surfaces are being painted or printed, fiducials are painted or printed onto the second surface, in accordance with step 506. These fiducials may be painted or printed periodically, after each line or a number of lines has been printed on the first surface, or they may be printed or painted after the graphic is completed on the first surface. Alternatively, they may all be printed before the first surface is printed. Preferably, they are painted or printed periodically, after each of a certain number of lines are printed on the first surface.

In accordance with step 507, the topography of the next surface is mapped. A wall mapping device is attached with the host device and steps across the length and height of the next surface. In addition to communicating obstacles along the next surface to the computing device, it communicates the position of the fiducials painted or printed in step 506 to the computing device. In this way, the computing device may produce motions in the host device and print head that will yield alignment of the graphics on each surface. In accordance with step 508, the next surface is painted or printed in like manner to the first surface.

Those skilled in the art will recognize that various elements of the current invention may be varied without departing from the invention's scope. For instance, the scaffolding system may be readily adapted to paint or print three or four surfaces, whether by integrating additional sections with the scaffolding system or by positioning the one or two surface embodiments of the invention relative to one another. Additionally, vertical drive assembly may be suited with a cherry-picker type of device that allows printing or painting at a certain distance beyond the height of the fully extended towers. Additionally, the invention may be used for surfaces other than room constructs, such as tables, screens, canvases and other surfaces to which the invention may be sized. Finally, it will be apparent to those skilled in the art that the order of the steps of the method disclosed herein may be varied without departing from the scope of the invention.

What is claimed is:

1. An apparatus to apply at least one graphic design to at least one surface, comprising:

a portable scaffolding;

wherein the portable scaffolding is telescopically scalable to a length or height of the at least one surface and a width of the at least one surface;

a host device that receives at least one head attachment;

a plurality of motors coupled to the host device and to the portable scaffolding;

wherein the plurality of motors communicate electronically with a computing device; and wherein the plurality of motors receive instructions from the computing device to move the host device along the width, and along the length or height, of the at least one surface and to move the host device toward and away from the at least one surface.

2. The apparatus of claim 1, wherein the portable scaffolding system further comprises:

at least two telescoping vertical members;

wherein the vertical members are connected via at least one telescoping horizontal brace extending between and perpendicular to the vertical members;

at least one travel bar connected between and perpendicular to the vertical members; and wherein one of the plurality of motors moves the host device along the width of the at least one surface by moving the host device along the travel bar.

3. The apparatus of claim 2, further comprising:

a drive assembly having a vertical drive motor and a horizontal drive motor;

wherein the vertical drive motor is connected with the host device via a vertical drive belt;

wherein the horizontal drive motor is coupled to the at least one travel bar via at least one horizontal drive rod;

wherein the horizontal drive motor and vertical drive motor electronically communicate with the computing device;

wherein the horizontal drive motor moves the drive assembly along the travel bar, by rotating the horizontal drive rod, when the horizontal drive motor receives instructions from the computing device to move the host device along the width of the at least one surface; and wherein the vertical drive motor retracts or extends the vertical drive belt when the vertical drive motor receives instructions from the computing device to move the host device along the length or height of the at least one surface.

4. The apparatus of claim 3, wherein:

the host device includes a host drive motor that moves the host device toward and away from the at least one surface and along the width of the at least one surface;

the host drive motor communicates electronically with the computing device; and wherein the host drive motor moves the host device along the width of the at least one surface, beyond a maximum horizontal movement of the drive assembly, when the host drive motor receives instructions from the computing device to move the host device along the width of the at least one surface.

5. The apparatus of claim 1, wherein the head attachment comprises at least one device selected from the group consisting of a print head, a paint head, and a wall mapping device.

6. The apparatus of claim 5, wherein the wall mapping device comprises a device selected from the group consisting of an optical sensor, a laser sensor, and a camera.

7. The apparatus of claim 6, wherein the wall mapping device also comprises an illumination device.

8. The apparatus of claim 1, wherein the computing device communicates with the plurality of motors via direct electrical connection.

9. The apparatus of claim 1, wherein the computing device communicates with the plurality of motors via remote communication means.

10. The apparatus of claim 1, wherein:

the host device includes a host drive motor that moves the host device toward and away from the at least one surface;

the host drive motor communicates electronically with the computing device; and the host drive motor moves the host device toward and away from the host drive motor, when the host drive motor receives instructions from the computing device to move the host device toward and away from the at least one surface.

11. The apparatus of claim 10, wherein the computing device communicates with the host drive motor via direct electrical connection.

12. The apparatus of claim 10, wherein the computing device communicates with the host drive motor via remote communication means.

13. The apparatus of claim 1, wherein:

the at least one head attachment comprises a print or paint head;

the print or paint head communicates electronically with the computing device; and wherein the print or paint head applies at least one pigment to the at least one surface, when the print or paint head receives instructions from the computing device to apply the at least one pigment to the at least one surface.

14. The method of claim 13, wherein:

the computing device receives a graphic design;

the print or paint head receives instructions from the computing device to apply a plurality of fiducials to the at least one surface; and the print or paint head receives instructions from the computing device to apply at least one pigment to the at least one surface, such that the graphic design is applied to the at least one surface in alignment with the plurality of fiducials.

* * * * *